United States Patent [19]

Rader

[11] 4,332,283

[45] Jun. 1, 1982

[54] DEVICE FOR SUPPORTING AND PROTECTING GOLF CLUBS

[75] Inventor: Richard S. Rader, Chatsworth, Calif.

[73] Assignee: Ajay Enterprises, Inc., Delavan, Wis.

[21] Appl. No.: 179,196

[22] Filed: Aug. 18, 1980

[51] Int. Cl.[3] ..... A63B 55/00

[52] U.S. Cl. ..... 150/1.5 R

[58] Field of Search ..... 150/1.5 R, 1.5 B, 1.5 C

[56] References Cited

U.S. PATENT DOCUMENTS

| | | | |
|---|---|---|---|
| 1,951,492 | 3/1934 | Schneider | 150/1.5 R |
| 2,938,559 | 5/1960 | Harkrader | 150/1.5 R |
| 3,101,108 | 8/1963 | Ingoldt | 150/1.5 R |
| 3,164,185 | 1/1965 | Ingoldt | 150/1.5 R X |
| 3,172,681 | 3/1965 | Moses | 280/47.19 |
| 3,361,307 | 1/1968 | Clare | 222/489 |
| 3,422,998 | 1/1969 | Murray | 222/567 |
| 3,996,983 | 12/1976 | Isnardi | 150/1.5 R |

FOREIGN PATENT DOCUMENTS

| | | | |
|---|---|---|---|
| 2220493 | 2/1973 | Fed. Rep. of Germany | 150/1.5 R |

OTHER PUBLICATIONS

Ajay "Club Gard", Golf Bag Model RG13 as Depicted on p. 16, from Ajay Summer Sports 1979 Catalog.

*Primary Examiner*—Donald F. Norton
*Attorney, Agent, or Firm*—Lee, Smith & Jager

[57] ABSTRACT

A golf bag assembly for individually supporting and protecting a plurality of golf clubs including a plate member secured to the bag and extending across the bag in proximity to the open upper end. The plate member includes a plurality of apertures to receive the shafts of golf clubs and boss portions extending a selected distance downwardly aligned with each of the apertures. A plurality of elongate golf club protecting tubes are engaged with said boss portions below said plate and extend downwardly into the bag. The protective tubes do not need reinforced rims. Golf clubs can be inserted within the golf bag and within each of the protective tubes without any damaging engagement between the clubs and the top portions of the tubes.

15 Claims, 5 Drawing Figures

C
24
20
30
30
30
24
30
20B
20A
32
22
20C
32
44
22
44
14
44
40
44
40
42
40
42
44
44
40
50
50
50
50
10
12
16
60
18

DEVICE FOR SUPPORTING AND PROTECTING GOLF CLUBS

BACKGROUND OF THE INVENTION

This invention relates generally to a golf bag assembly for supporting and protecting a plurality of golf clubs, and more particularly relates to an improved supporting and protecting plate for use with golf bags and the like.

The sporting goods industry is constantly upgrading the design and construction of golf bags, to give the bags an attractive appearance and to provide maximum protection for the equipment carried in the bags. A major trend in the golf bag industry, for example, is to arrange a bag so that each golf club is individually supported and protected within a protective tube in the bag. By such an arrangement, the shafts of the golf clubs do not become entangled as the bag is carried. Also, the frictional contact between the clubs and the potential damage to the grips and shafts, are minimized by the protective tubes. The use of protective tubes for each club also prevents the clubs from bunching up in the bag, and thereby minimizes the potential damaging engagement between the club heads.

The prior designs for golf bag assemblies including protective tubes have had certain disadvantages. For example, some prior systems do not allow for the placement of the protective tubes within a golf bag economically and efficiently. Some prior designs also mount the tubes in the golf bag in a manner which allows damage to either the clubs or to the tubes. It has been found that the upper rims or edges of the tubes in those prior designs are subject to high impact forces over prolonged periods of time, from the movement of the clubs in the tubes. Such impact forces damage the tubes by causing splits or cracks in the top of the tubes. The damaged tubes may not support the golf clubs in the proper position, and may damage the golf clubs as the clubs are inserted in or withdrawn from the tubes.

The problems presented by the damage to the tubes has resulted in the use of reinforcing rims at the top of the tubes. However a major drawback to the use of the reinforced rims is that it substantially increases the cost of the tubes. Furthermore, even with the reinforcing rims, the exposure of the tube to constant impact by a golf club can fracture the tube material and cause damage to the tube and clubs.

The present invention provides a golf club assembly which overcomes the foregoing problems. In accordance with this invention, golf clubs can be individually supported and protected in protective tubes within a golf bag in a manner which minimizes the potential damage to the club and the tubes as the bag is used. The need for reinforcing the rim of the protective tubes also is eliminated, and the golf bag assembly can be manufactured and maintained at a reduced cost.

To accomplish these objects, the golf bag assembly of the present invention includes an improved golf club and protective tube supporting plate member. This plate member extends across the opening in the bag, and includes a plurality of apertures dimensioned to received golf club shafts. These apertures are spaced laterally on the plate member at a selected distance, to maintain the clubs at a prescribed arrangement within the bag, to thereby minimize the engagement between the club heads.

Moreover, the lower portion of the plate member in accordance with this invention includes a downwardly projecting boss portion below and substantially concentric with each of the club receiving apertures. These boss members are adapted to engage with the top portion of elongate protective tubes which are inserted on the bosses from below. The top of the tubes are therefore isolated by the plate member from impact by the golf club shafts or head when the golf club is inserted through the aperture and the boss into the associated protective tube. As a result, potentially damaging engagement between the club and the upper end of the protective tube is minimized or eliminated. The need for periodic replacement of damaged protective tubes is also reduced, with an attendant reduction in bag maintenance and repair costs. Also, the expense of the assembly is reduced by the elimination of the reinforcing rings in the top rim of each protective tube.

EXEMPLARY EMBODIMENT

Further objects and features of the present invention will become apparent from a description of an illustrated embodiment thereof, taken in conjunction with the accompanying drawings in which.

Figure 1:
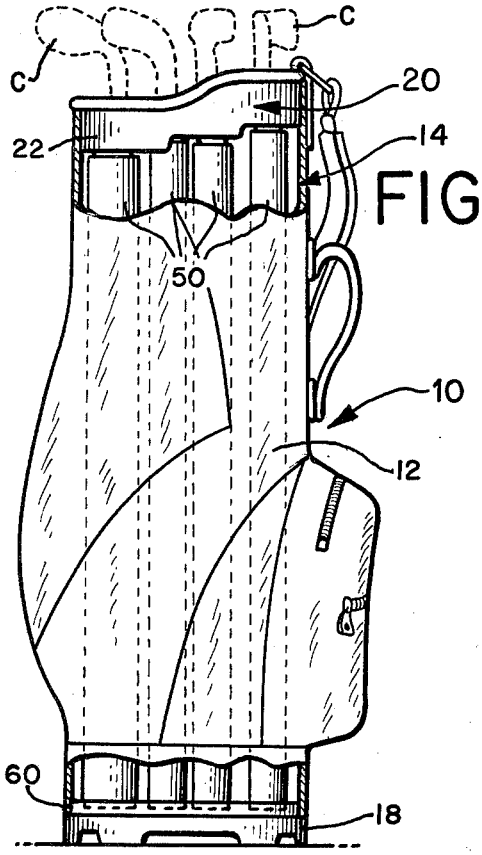
FIG. 1 is an elevational view in partial section of a golf bag assembly in accordance with the present invention.

Referring generally to FIG. 1, the golf bag assembly in accordance with this invention is generally referred to by the reference 10. The golf bag 10 includes a conventional elongate and generally cylindrical bag body 12 which has an upper end 14 and a lower end 16. The lower end 16 is closed by a bottom closure plate 18. The upper end 14 is opened for receiving the golf clubs which are indicated generally by the reference C, as shown in phantom in FIG. 1.

In accordance with this invention, the top portion of the bag body 12 is closed by a supporting and protective plate 20. In the preferred embodiment, the plate 20 is provided with a stepped cross-sectional configuration so that the plate defines a plurality of plate portions 20A, 20B, and 20C. As shown clearly in FIG. 3, these plate portions 20A–C are at different levels and at different distances from the bottom plate 18 of the bag 10. The bag 10 is thereby adapted to receive and effectively support clubs C having shafts of varius lengths. An upturned peripheral flange 22 is provided around the plate 20. This flange 22 is designed to secure the plate 20 in the top portion of the bag 10 by stitching, by adhesive contact, or by other suitable means. A reinforcing rim 24 is also provided to strengthen the plate 20 and facilitate the mounting within the bag 10.

Figure 2:
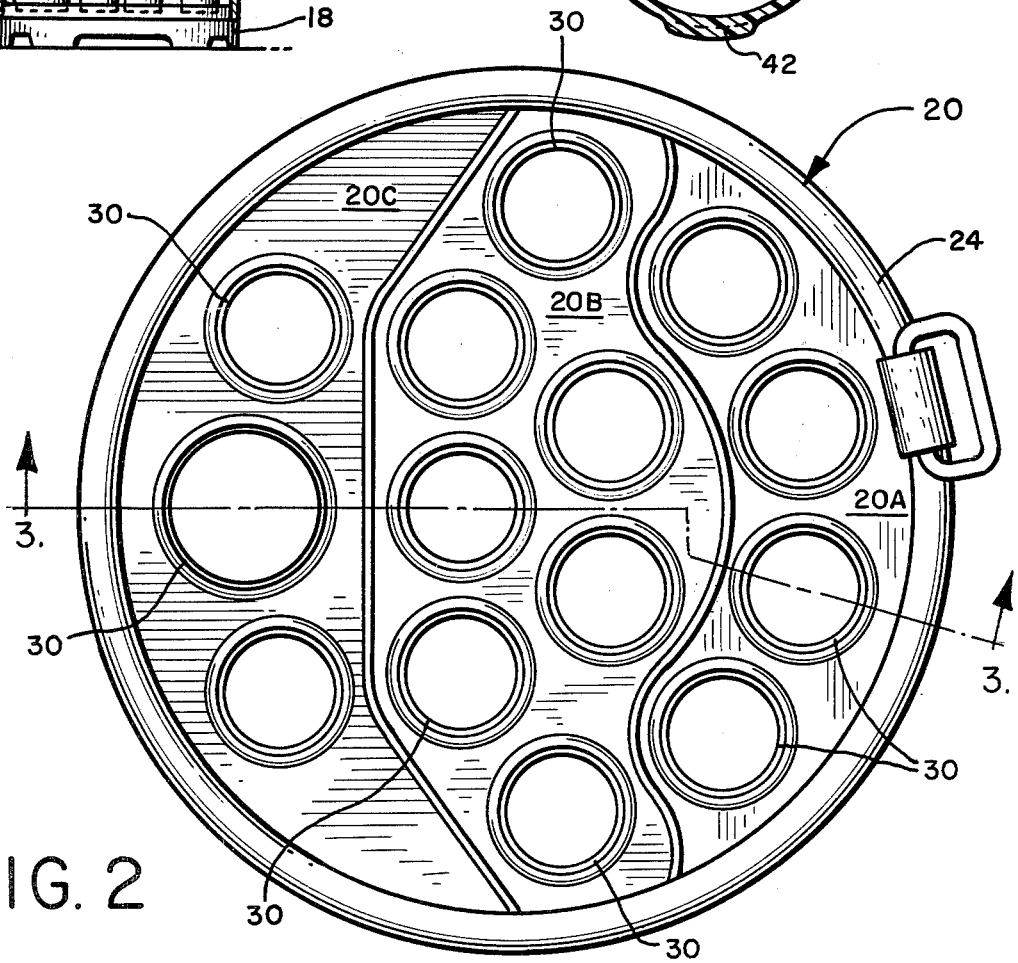
FIG. 2 is an enlarged plan view of the supporting and protecting plate member pursuant to the present invention, shown installed within the bag assembly of FIG. 1.

In accordance with this invention, the plate member 20 includes a plurality of club-receiving apertures 30. As shown in FIG. 2, each of the different levels of the multi-level plate portions 20A–C include a plurality of apertures 30. These apertures 30 are spaced laterally on the plate 20 a selected distance, to space the heads of the clubs C sufficiently to minimize contact between the clubs during storage and transport. In the illustrated arrangement, each aperture 30 is circular in configuration, and has a diameter selected to readily receive a standard golf club shaft. Of course, other shapes, such as oval or rectangular, can be used to define the apertures 30 in the plate member 20, without departing from this invention.

Figure 4:
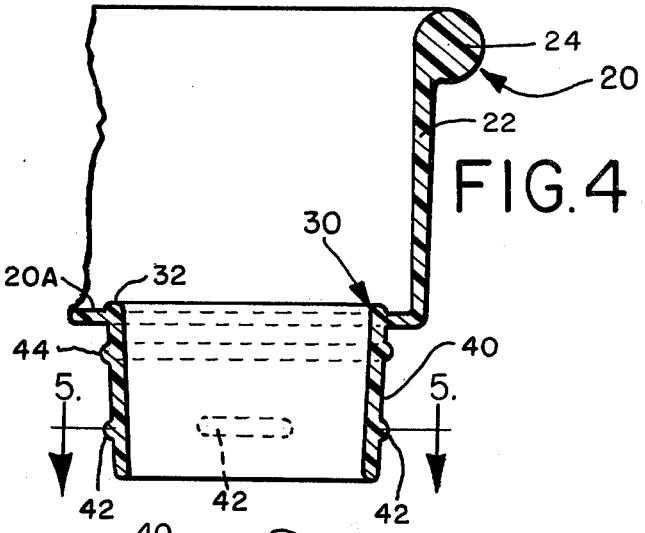
FIG. 4 is a removed partial cross-sectional view of a tube-supporting boss portion provided in the plate member in accordance with this invention.
Figure 5:
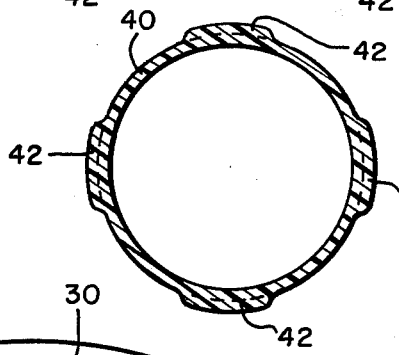
FIG. 5 is a cross-sectional view of the tube-supporting boss portion taken along the line 5—5 in FIG.4.
Figure 3:
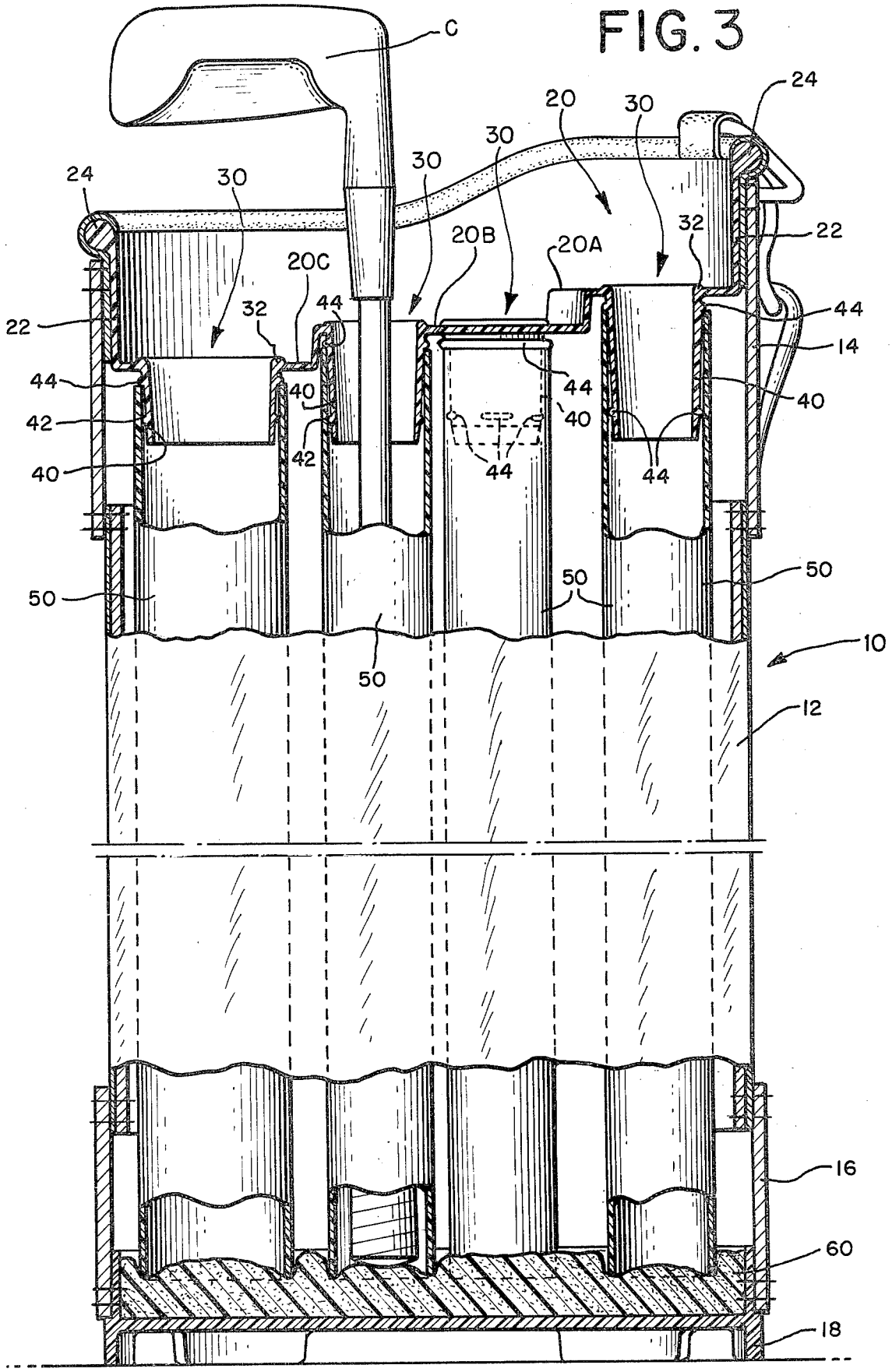
FIG. 3 is an enlarged cross-sectional elevational view of the golf bag assembly, including the supporting and protecting plate member, taken along the line 3—3 in FIG. 2.

The plate 20 also includes a plurality of boss portions 40, as illustrated clearly in FIGS. 3 and 4. Each boss portion 40 is positioned below and is substantially concentric with each of the apertures 30 provided at the plate 20. The boss portions 40 extend a substantial distance downwardly below the plate 20, and are preferably frusto-conical in configuration, with a downwardly converging taper. Each boss 40 also includes an interrupted rim 42, as shown in FIG. 5, and a continuous rim 44 on the external surfaces of the boss. Again, the bosses 40 can be other shapes, such as oval or rectangular, if desired.

This frusto-conical configuration for the boss 40, and the protruding external rims 42 facilitates the frictional engagement of the boss 40 with the internal diameter of the top portion of an elongate golf club protective tube 50. As clearly shown in FIG. 3, the top edge of the tubes 50 can be arranged in abutting relationship with the rim 44, to thereby stabilize the tubes. As shown clearly in Fig. 3, one tube 50 is frictionally engaged with each boss 40, and extends downward into engagement with the bottom plate 18 of the bag 10. As also seen in FIG. 3, the top rims of the tubes 50 do not include any reinforcing rings. In one optional embodiment, the bag 10 can include a flexible pad 60, made from a material such as foam rubber, or styrofoam or the like. As shown in FIG. 3, the insertion of the tubes 50 into the bag 10 will compress the pad 60 so that the pad operates to secure the bottom portion of the tubes 50 from movement within the bag 10.

The arrangement of the boss portions 40 in frictional engagement inside the top of the tubes 50 isolates the tubes 50 from physical engagement by the shafts of the clubs C, as the clubs are inserted into or withdrawn from the tubes. Instead, the shafts of the clubs C will engage with the plate 20 at the internal periphery of the aperture 30, and with the boss 40. The isolation of the tubes 50 from impact by the golf clubs C substantially minimizes or eliminates the splitting or fracture of the tubes during the use of the bag 10. As a result, the need for a reinforcing rim on the top of the tubes 50 is eliminated, and the tubes can be made of a lightweight material. Damage to the clubs and club shafts is also reduced.

In the preferred form of the invention, the top plate member 20 is injection molded from high-impact plastic, or from other suitable material. As shown in FIGS. 3 and 4, the plate 20 is molded so that the bosses 40, as well as the flange 22, are integral with the plate 20. Furthermore, each aperture 30 is preferably molded with a reinforcing ridge 32, as shown in FIG. 4. The ridge 32 strengthens the juncture between the boss 40 and the plate 20, by providing additional material during the molding operation. In addition, the reinforcing ridge 32 provides a smooth and rounded edge to the aperture 30 which will engage with the grip and shaft portion of the club C, as the club is inserted within the bag 10. As a result of this construction, the wear and damage to the club shaft and grip are minimized. Potential wear on the edges of the apertures 30 of the plate 20 is also reduced.

When the bag assembly 10 is constructed in accordance with this invention, the bag body 12 can be provided with a bottom plate 18 and the optional flexible pad 60. Then, the club supporting and protecting plate member 20 can be joined to a plurality of tubes 50, by inserting one tube 50 into firm frictional engagement with each boss portion 40. These tubes 50 are of a selected length, so that the positioning of the tubes 50 and plate 20 within the bag 10, as shown in FIG. 3, will permit the bottom of each tube to rest on the pad 60 or the bottom plate 18. The bag is made ready for use by securing the flange 22 of the plate 20 to the top portion 14 of the bag 10. The clubs C can then be inserted within each of the tubes 50, through the apertures 30 and the bosses 40.

Although the foregoing has been a description of a specific embodiment of the invention, it will be apparent to one skilled in the art that various changes and modifications can be made without departing from the scope and spirit of the invention, as defined by the following claims.

What is claimed is:

1. A golf club protective device for use with a golf bag and club-receiving tubes comprising;

a plate member having a selected external configuration for being positioned and retained with a golf bag across the bag opening;

a plurality of apertures within said plate member each dimensioned to receive the shaft of a golf club and spaced laterally on said plate member to separate clubs in adjacent apertures a selected distance;

a boss portion integrally formed with said plate member adjacent and substantially aligned with each aperture and extending downwardly from said plate member a selected distance from the associated aperture and having a downwardly converging external configuration adapted to engage with the inside of the top portion of an elongate club-receiving tube positioned within the golf bag below said plate member, whereby said protective device will firmly retain said tubes in selected positions within said golf bag and allow individual clubs to be inserted into said tubes for protection without potentially damaging engagement between the top portion of said tubes and the golf club.

2. A golf club protective device in accordance with claim 1 wherein each boss portion has a downwardly converging frusto-conical configuration adapted to frictionally engage within the inside of the top portion of a club-receiving tube.

3. A golf club protective device in accordance with claim 1 wherein each boss portion includes integrally formed and outwardly projecting external rim means for increasing frictional engagement between said boss portion and said club-receiving tube.

4. A golf club protective device in accordance with claim 3 wherein said rim means on each boss portion includes a lower interrupted rim to enhance the frictional engagement of said boss portion with said club-receiving tube.

5. A golf club protective device in accordance with claim 1 wherein said integrally formed boss member terminates in a circular reinforcing ridge positioned on the top surface of said plate member and arranged for engagement with the shafts of golf clubs inserted into the associated aperture.

6. A golf club protective device in accordance with claim 1 wherein said plate member includes a peripheral flange formed integrally with said plate for securing said plate within said opening in the top portion of said golf bag.

7. A golf club protective device in accordance with claim 1 wherein said plate member has a stepped cross-sectional configuration to define multiple plate portions each containing a plurality of said apertures, whereby said protective device is adapted to readily receive and retain golf clubs having shafts of varying length.

8. A golf bag assembly for individually supporting and protecting a plurality of golf clubs comprising:

a golf bag having an open upper end and a closed lower end;

a plate member secured to said bag and extending across the bag in the proximity of the open upper end;

a plurality of apertures provided in said plate member each dimensioned to receive the shaft of a golf club and spaced laterally on said plate member to separate clubs in adjacent apertures a selected distance;

a boss portion integrally formed with said plate member below and substantially aligned with each of said apertures extending downwardly a selected distance from said plate member and having a downwardly converging external configuration;

a plurality of elongate protective tubes extending within said bag below said plate member and toward said closed lower end of said bag, each of said tubes having an upper end frictionally engaged with said external configuration of one of said boss portions on said plate member to align each tube with one of said apertures and restrain said tubes from substantial movement within said bag;

whereby a golf club can be individually supported and protected in each tube by extending the golf club shaft downwardly through said aperture and said boss portion in a manner which minimizes potentially damaging engagement between the club shaft and the upper end of said protective tube.

9. A golf club assembly in accordance with claim 8 wherein the upper end of each protective tube is joined to each boss portion with an unreinforced rim.

10. A golf bag assembly in accordance with claim 8 wherein said elongate protective tubes extend downwardly adjacent the closed lower end of said bag and further wherein said assembly includes a flexible cushion member adjacent the closed lower end of said bag for engaging with and gripping the lower end of each protective tube.

11. An assembly in accordance with claim 8 wherein each boss portion has a downwardly converging frustoconical configuration which facilitates the frictional engagement with the inside of the top portion of the associated protective tube.

12. An assembly in accordance with claim 8 wherein each boss portion includes outwardly projecting external rim means for increasing the frictional engagement between said boss portion and the associated protective tube.

13. The assembly in accordance with claim 12 wherein said rim means on each boss portion includes a lower interrupted rim to enhance the frictional engagement of said boss portion with the associated protective tube.

14. An assembly in accordance with claim 8 wherein each boss portion includes a circular reinforcing ridge positioned on the top surface of said plate member and arranged for engagement with the shafts of golf clubs inserted into said apertures.

15. An assembly in accordance with claim 8 wherein said plate member includes an integral peripheral flange for securing said plate member to said bag, and said plate member further defines multiple-level plate portions each containing a plurality of said apertures, to facilitate the support of golf clubs having shafts of varying length.

* * * * *